US005758708A

United States Patent [19]

Beckwith et al.

[11] Patent Number: 5,758,708

[45] Date of Patent: Jun. 2, 1998

[54] METHOD OF MAKING SAND CORES

[75] Inventors: Elaine Cecilia Beckwith, Northville; Warren Benjamin Copple, Trenton; James Stewart Rankin, II, Novi; Scott Raymond Zimdars, Canton, all of Mich.

[73] Assignee: Ford Global Technologies, Inc., Dearborn, Mich.

[21] Appl. No.: 726,372

[22] Filed: Oct. 4, 1996

[51] Int. Cl.[6] ..... B22C 9/10; B22C 15/24

[52] U.S. Cl. ..... 164/21; 164/200; 164/201

[58] Field of Search ..... 164/21, 19, 20, 164/22, 28, 186, 228, 200, 201, 202

[56] References Cited

U.S. PATENT DOCUMENTS

| | | | |
|---|---|---|---|
| 2,538,770 | 1/1951 | Fea | 164/200 |
| 4,750,540 | 6/1988 | Boenisch | 164/200 X |
| 4,794,976 | 1/1989 | Peterle | 164/202 X |
| 4,912,332 | 3/1990 | Siebel et al. . | |
| 5,135,043 | 8/1992 | Drake . | |
| 5,354,788 | 10/1994 | Johnson et al. . | |
| 5,535,809 | 7/1996 | White | 164/20 |

*Primary Examiner*—J. Reed Batten, Jr.
*Attorney, Agent, or Firm*—Joseph W. Malleck

[57] ABSTRACT

A closed core box is provided with one or more inlets for receiving and passing gas fluidized resin-coated sand to fill the interior of such core box, and with one or more screened outlets for allowing egress of such gas. A closed cylindrical or angular sand-fluidizing chamber is provided for each of the inlets, the chamber having one end connectable to a pressurized gas supply and an opposite end communicating with an inlet. At least part of each chamber is filled with resin-coated sand and a non-porous piston is placed on the sand within each chamber, each piston providing an annular gap (i.e. about 1/16 of an inch) with the interior of such chamber to direct the gas supply along the periphery of the chamber interior. The pressurized gas supply (40–80 psi) is connected to the chamber above the pistons whereby gas will move past each of the pistons to fluidize the sand therebelow in the chamber in a manner that continuously and toroidally recirculates the sand away from the periphery of the chamber while communicating with an inlet to the core box to promote smooth fluidized flow through such inlet, the piston moving down with the top level of the sand in the chamber as sand moves through the inlets.

12 Claims, 3 Drawing Sheets

METHOD OF MAKING SAND CORES

TECHNICAL FIELD

This invention relates to the technology of making intricately shaped cores from granular refractory material, the cores being useful in molding metal castings, and more particularly to the techniques of blowing resin-coated sand material into core box cavities to define such cores.

DISCUSSION OF THE PRIOR ART

It is commercially typical to mix finely divided silica sand with a binder and blow such mixture into the cavity of a core box to form a densely packed sand core therein. The packed sand and binder must then be cured to impart strong physical properties so the core can withstand some degree of physical abuse in handling and withstand thermal shock when it comes into contact with molten metal during a casting operation. Depending on the nature of the binder, either heat or a chemical agent is usually used to effect such curing. But such curing cannot overcome defects related to variably blown density or non-filled areas (void spaces or missing sections) in the intended core shape; these result from variations in the blowing step. Moreover, such density variations or voids interfere with proper curing of the core and also result in bad metal castings because of incorrect metal shape (i.e. not being desired net-shape).

Core box blowing is usually carried out by use of a magazine apparatus that includes a flat blow plate having numerous funnel shaped apertures extending though the plate. A four-walled sand fluidizing box is placed on and sealed to the top of the plate to extend upwardly along the periphery of the plate; this defines a fluidizing box interior or cavity that extends across all of the apertures. The fluidizing box is filled with resin-coated sand and it is usual to place a closure plate across the box, the plate having an entrance for introducing pressurized air. The air attempts to pass through the fluidizing box interior to exit through the plate apertures and in the process stirs the sand to create a fluidized sand suspension. Quite often, the air pressure will seek the path of least resistance, which is along the center of the apertures permitting some of the resin-coated sand to collect along the sides of the apertures or funnel, or along the sides of any tube communicating with the apertures. This is sometimes referred to as "rat-holing" wherein sand clings to the outer circumference of a blow tube or area immediately above an extended blow tube. This leads to inadequate filling of parts of the core box cavity because the blow tube or apertures have changed their geometry as a result of the collection or rat-holed sand. This will lead to a variable sand mass flow rate that changes during a run or changes from run-to-run.

SUMMARY OF THE INVENTION

It is an object of this invention to provide a solution to the problem of inadequate sand filling of the core box cavity and to the problem of rat-holing that allows sand to accumulate in the blow tubes or surrounding areas.

The method of this invention that meets the above object makes a sand core that is useful for use in creating a near-net shape metal casting. The method comprises (a) providing a closed core box with one or more inlets for receiving and passing gas fluidized resin-coated sand to fill the interior of such core box, and with one or more screened outlets for allowing egress of such gas; (b) providing a closed cylindrical sandfluidizing chamber for each of the inlets, the chamber having one end connectable to a pressurized gas supply and an opposite end communicating with an inlet; (c) filling at least part of each chamber with resin-coated sand and imposing a non-porous piston on the sand within each chamber, each piston providing an annular gap with the interior of such chamber to direct the gas supply along the periphery of the chamber interior; and (d) connecting the pressurized gas supply to the chamber above said pistons whereby gas will move past each of the pistons to fluidize the sand therebelow in the chamber in a manner that continuously and toroidally recirculates the sand away from the periphery of the chamber while communicating with an inlet to the core box to promote smooth fluidized flow through such inlet.

The pressurized supply of air may be in the range of 40–80 psi, and the gap defined about the piston, taken with respect to the chamber, may have a radial spacing of about 1/16th of an inch.

DETAILED DESCRIPTION AND BEST MODE

Figure 1:
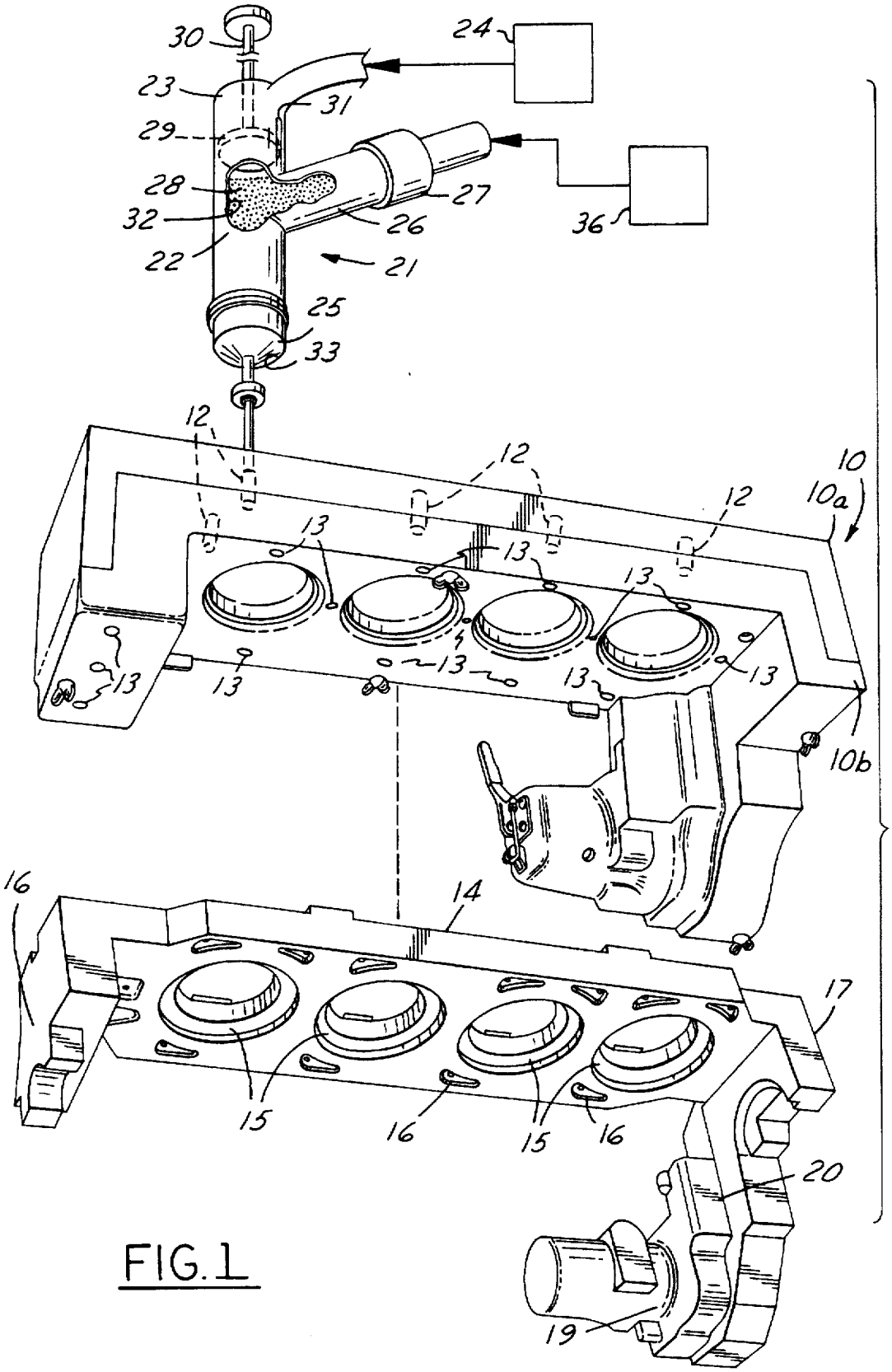
FIG. 1 is an exploded composite view of one example of an apparatus embodying the principles of this invention that is useful in making a head deck slab core; the head slab core cooperates with other cores to define an engine block for an automobile; the figure depicts one fluidizing chamber, blowing apparatus, core box, and resulting blown core.

As shown in FIG. 1, a core box 10 has at least two parts (10*a* and 10*b*), which together define an internal cavity 11 with a large number of inlets 12 to receive and pass a body of gas-fluidized resin-coated sand to fill such interior cavity. The gas carrying the resin-coated sand exits from the core box cavity (without the sand) through a plurality of screened outlets 13. The core box cavity illustrated is effective to define a deck slab core, which is one of several complex cores used to define an engine block for an automobile engine when carrying out metal casting of such block. The cavity has four major sections to define: a slab portion 14 which has four circular recesses 15 defining (i) contours for eventually holding other core inserts that define the combustion chambers for the cylinders (not shown) and (ii) core prints 16 for interlocking the related cores assembled thereto; end wall portion 17 and opposite end wall portion 18 which define interlocking surfaces for assembling other cores; and (iii) an oil gallery portion 19 which is cantilevered by arm 20.

Such an intricate core box cavity necessitates a large number of inlets to reduce and commonize the path length from inlet to outlet and thereby achieve a proper packing density of the sand therein and to carry out filling of such sand in a rapid period of time. For example, notice the use of four inlets located along the slab portion 14. Two inlets are used to pack the cavity for the end wall portion 18, and two inlets are used to pack the end wall portion 17. Three inlets are used to pack the cavity for the gallery portion 19. The number of inlets is related to the need to assure proper packing density. Each inlet shown in FIG. 1 is shaped as a circular cylindrical passage drilled in the upper part 10*a* of the core box; each inlet has a diametrical dimension in the range of 0.375–0.750 inches, preferably about 0.625 inches.

Figure 2:
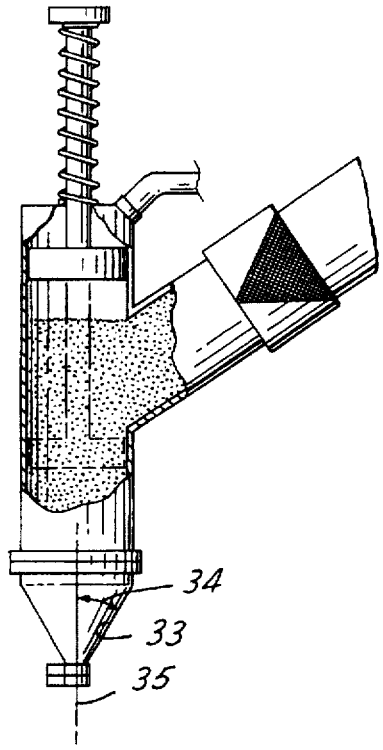
FIG. 2 is an enlarged sectional view of the fluidizing chamber shown in FIG. 1.

The blowing apparatus 21, in its broadest essential aspects (refer to FIGS. 1 and 2), comprises at least one sand-fluidizing chamber 22 having a top end 23 connected to a pressurized gas supply 24 and a lower end 25 in communication with an inlet 12 to the core box cavity 11. Resin-coated sand from a supply 36 is introduced to the chamber 22, through a supply channel 26 containing a one-way check valve 27, to a level 28 that provides sufficient sand volume to pack the intended zone or portion of the cavity which it serves. A weighted (or equivalent force applying means 30) urges non-porous piston element 29 onto the top level 28 of the filled sand. The piston element 29 has a size and a shape to provide an annular gap 31 with the chamber interior surface 32. The radial gap 31 is in the size range of 0.06–0.20 inches (preferably about 0.06 inches). The cross-sectional area of each chamber is generally larger than the cross-sectional area of each inlet 12 and thus a funnel wall 33 provides a transition between such differing cross-sectional areas. The angle 34 of such funnel-shaped wall with respect to the axis 35 of the chamber is within the range of 30° to 60°. If the angle exceeds 60°, then the width of the chamber may be interfered with to accommodate such an angle; if the angle is less than 30°, then the height of the chamber may be interfered with to accommodate such angle.

Figure 6:
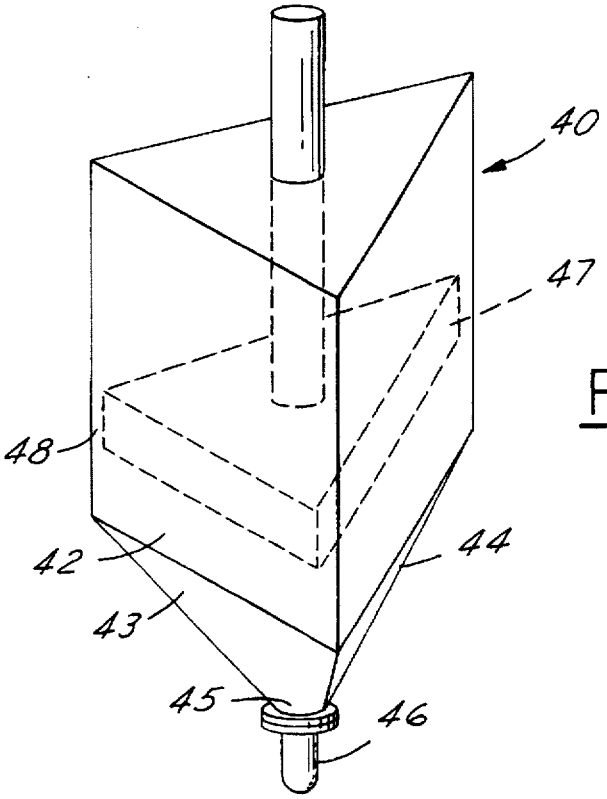

When gas pressure or air pressure of about 40–80 psi is applied above the piston element 29, the gas will flow around the piston element, through the gap 31 to scrub the interior surface wall 32 in order to fluidize the sand. This creates a radially inwardly recirculating pattern of moving sand grains. Although it is desirable to mount the chambers 22 directly on the core box, it may be necessary to carry the chambers on a blow plate suspended or elevated above the core box, which blow plate allows communication between the blowing apparatus and core box by way of tubing. Such elevated blowing apparatus can then accommodate a large number of inlets by subdividing the large chamber into subchambers, each subchamber being connected to an inlet (not shown). Such subdivisions may be carried out by planar walls arranged in an egg crate fashion which could result in rectangular or triangular shaped chambers 40 such as shown in FIG. 6. The bottom 41 of each subchamber has a funnel shape created by having planar walls 42, 43, 44 meeting at an apex 45 holding a nipple 46 which connects to a respective inlet. Piston elements 47 functioning within such subchamber are generally shaped to the cross-section to create an annular gap 48 for each subchamber that is rectangularity or triangularly shaped.

Figure 4:
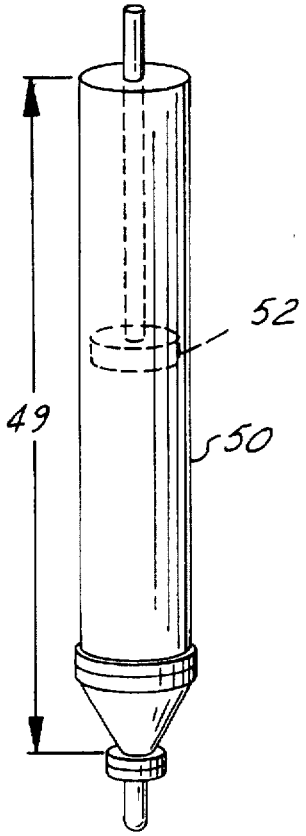
FIGS. 4, 5 and 6 are enlarged perspective views of fluidizing chambers illustrating alternative modifications keeping within the principles of this invention.
Figure 5:
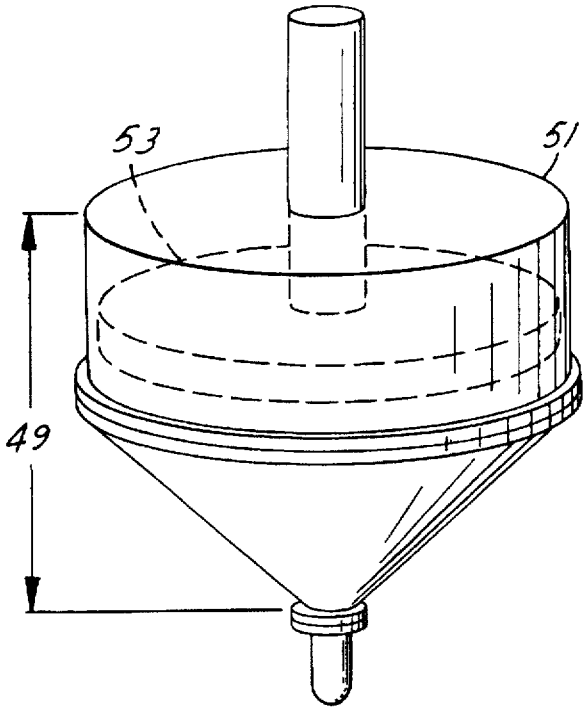

As indicated earlier, the subchambers may also be configured as circular cylinders as shown in FIGS. 4 and 5. The height 49 of the chambers can be varied as long as the volume of sand is sufficient in the fluidized zone to fill the cavity. The tall and narrow chamber 50 of FIG. 4 can contain the same volume of sand as the shorter but stouter chamber 51 of FIG. 5. The respective pistons 52 and 53 again create the same annular gaps.

This method overcomes the problem of existing sand-blowing techniques where (i) sand does not fill the magazine consistently from run to run, (ii) some blow tube areas are not filled or are only partially filled with sand, (iii) the cured sand may set-up and block the outlet orifice from previous runs using the same blowing apparatus, (iv) rat-holing caused by packing of sand around the outer circumference of a blow tube area immediately above a blow tube, and (v) changes in sand mass flow rate that promote a non-uniform packing density or promote variable porosity in the sand core. Preferably, this method works optimally when the sand has a particle size in the range of 10 to 600 microns, the resin which coats the sand particles and air provides a sand mixture viscosity in the range of 0.10 to 100 poises, and the angle of the funnel, leading from the fluidizing chamber, is in the range of 30° to 60°.

Figure 3:
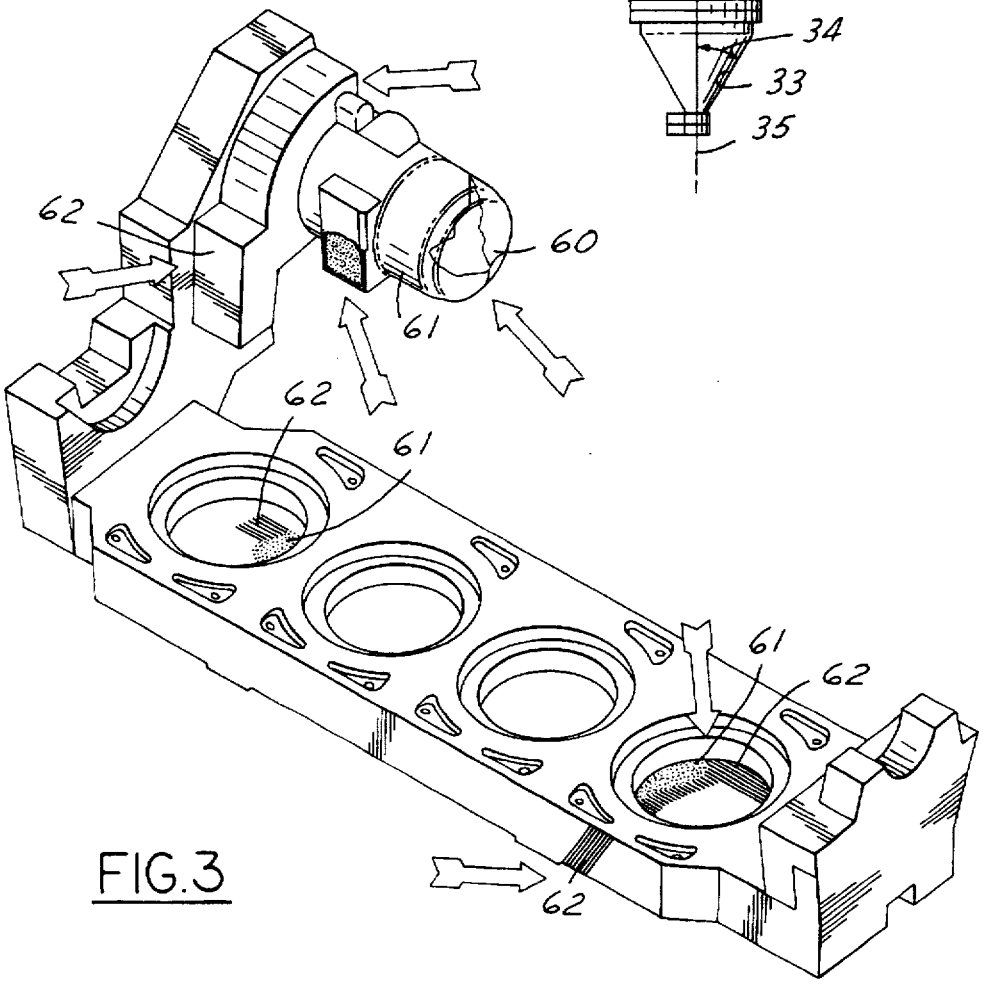
FIG. 3 is an enlarged view of the blown slab core illustrating defects that result from use of prior art blowing apparatus.

As shown in FIG. 3, any one of the above deficiencies can result in non-uniform packing density and may cause areas 60 or chunks to be absent sand as a result of insufficient input particularly caused by rat-holing. Other areas can be non-uniform as areas 61 which are very low density of about 0.8 g/cc and areas 62 which are also low density of about 1.0 g/cc. The core should have a uniform density of about 1.6 g/cc throughout and this is assured by practice of this invention.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of making a sand core that is useful in creating a near-net shape metal castings, comprising:

(a) providing a closed core box with one or more inlets for receiving and passing gas-fluidized resin-coated sand to fill the interior of such core box, and with one or more screened outlets for allowing egress of said gas;

(b) providing a closed cylindrical sand fluidizing chamber for each of said inlets, said chamber having one end connectable to a pressurized gas supply and an opposite end communicating with an inlet;

(c) filling at least part of each chamber with resin-coated sand and imposing a non-porous piston on said sand within each of said chambers, said piston providing an annular gap with the interior of such chamber to direct the gas supply along the periphery of said chamber interior; and (d) connecting a pressurized gas supply to said chamber above said piston whereby gas will move past each of said pistons to fluidize the sand therebelow in said chamber in a manner that continuously and toroidally recirculates the sand away from the periphery of the chamber while promoting smooth fluidizing flow through said inlet, said pistons moving down along with the top of the sand level as the sand moves through the inlet.

2. The method as in claim 1 in which a control valve is interposed in said opposite end of the chamber to permit sand to fill said chamber prior to fluidization and supply to the core box.

3. The method as in claim 1 in which each inlet has a cross-sectional size to permit the nonfluidizing sand in step (c) to stack up at said inlet and permit filling of said chamber prior to admission of the fluidizing gas.

4. The method as in claim 3 in which said cross-sectional size of each said inlet is no greater than about 0.75 inches.

5. The method as in claim 1 in which in step (c) sufficient sand volume is filled into each of said chambers to ensure proper filling of the core box cavity when said sand is fluidized in step (d).

6. The method as in claim 1 in which the gas supply of step (d) has a pressure in the range of 40–80 psi.

7. The method as in claim 1 in which said piston used in step (c) defines an annular gap of about 0.06 inches.

8. The method as in claim 1 in which the cross-sectional shape of said chamber is larger than said inlet and a funnel connects the chamber and inlet.

9. The method as in claim 8 in which variations in supply pressure, inlet size and funnel angle are selected to promote consistent flow rate.

10. The method as in claim 1 in which the height and cross-sectional area of the chamber is related to (i) the volume of sand needed to ensure filling of the core box cavity and (ii) the size of each inlet needed to provide a predetermined fill time.

11. The method as in claim 1 in which the particle size of said sand used to fill said core box cavity is in the range of 10 to 600 microns, and the resin coated sand/air mixture has a viscosity of 0.1 to 100 poises, thereby determining the packing density.

12. A method of filling a core box with particulated resin-coated sand, the core box having a complex internal cavity with (i) a plurality of inlets located to deliver fluidized resin-coated sand to different zones of the cavity and (ii) a plurality of screened outlets for allowing egress of gases comprising:

(a) providing a sand fluidizing magazine containing a plurality of chambers each in communication with one of said core box inlets and each connectable to a pressurized gas supply;

(b) filling at least part of each chamber with resin-coated sand and placing a weighted non-porous flow modulating piston on top of said sand in each of said chambers, each piston providing an annular gap with the interior of each such chamber to direct the gas supply flow along the periphery of each chamber interior, said piston moving down with the top of the sand level as the sand moves through an inlet; and (c) connecting a pressurized gas supply to said magazine above said piston whereby gas will move past each of said pistons to fluidize the sand therebelow in said chamber in a manner that is a recirculating toroid that continuously moves the sand away from the periphery of the chamber and promotes smooth fluidized flow through said inlet.

* * * * *